US006296978B1

(12) United States Patent
Takaya et al.

(10) Patent No.: US 6,296,978 B1
(45) Date of Patent: Oct. 2, 2001

(54) ELECTROPHOTOGRAPHIC PHOTOSENSITIVE MEMBER, A PROCESS-CARTRIDGE INCLUSIVE THEREOF, AND AN IMAGE FORMING APPARATUS

(75) Inventors: Itaru Takaya, Numazu; Kazuo Yoshinaga, Kawasaki; Yuko Sato, Numazu; Katsumi Aoki, Yokohama; Masataka Kawahara, Shizuoka-ken; Keiko Hiraoka, Tokyo, all of (JP)

(73) Assignee: Canon Kabushiki Kaisha, Tokyo (JP)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 09/065,525

(22) Filed: Apr. 24, 1998

(30) Foreign Application Priority Data

Apr. 30, 1997 (JP) ..... 9-112639

(51) Int. Cl.[7] ..... G03G 5/047; G03G 5/147

(52) U.S. Cl. ..... 430/58.2; 430/66; 399/159; 399/111

(58) Field of Search ..... 430/58.2, 58.7, 430/66, 96; 399/159, 111

(56) References Cited

U.S. PATENT DOCUMENTS

| | | | | |
|---|---|---|---|---|
| 3,957,725 | | 5/1976 | Limburg | 260/46.5 R |
| 5,230,976 | | 7/1993 | Schank et al. | 430/59 |
| 5,254,423 | | 10/1993 | Mayama et al. | 430/58 |
| 5,283,142 | | 2/1994 | Mayama et al. | 430/58 |
| 5,326,661 | | 7/1994 | Sansone et al. | 430/20 |
| 5,418,099 | | 5/1995 | Mayama et al. | 430/58 |
| 5,422,210 | | 6/1995 | Mayama et al. | 430/59 |
| 5,879,847 | * | 3/1999 | Yoshinaga et al. | 430/67 |

FOREIGN PATENT DOCUMENTS

| | | | |
|---|---|---|---|
| 0224784 | | 11/1986 | (EP) . |
| 55-095953 | * | 7/1980 | (JP) . |
| 57-30843 | | 2/1982 | (JP) . |
| 61-132954 | | 6/1986 | (JP) . |
| 4-324454 | | 11/1992 | (JP) . |

OTHER PUBLICATIONS

English translation of JP 55–217240, Jul. 1980.*
Chemical Abstracts 94:112490, 1980.*
Patent Abstracts of Japan, vol. 4, No. 146 [P–031], Oct. 1980 for JP 55–095953.
Patent Abstracts of Japan, vol. 98, No. 9, Jul. 1998 for JP 10–095787 published Apr. 14, 1998.

* cited by examiner

*Primary Examiner*—Christopher Rodee
(74) *Attorney, Agent, or Firm*—Fitzpatrick, Cella, Harper & Scinto

(57) ABSTRACT

The present invention provides an electrophotographic photosensitive member having a substrate and a photosensitive layer thereupon, wherein a surface layer of the photosensitive member contains a resin which is obtained by being subject to polycondensation as a monomer component only an organosilicon-modified positive hole transporting compound; a process cartridge which has, in addition to the electrophotographic photosensitive member, at least one from among a primary charging means, a developing means, and a cleaning means placed into a housing; and the image forming apparatus using the electrophotographic photosensitive member.

12 Claims, 6 Drawing Sheets

ELECTROPHOTOGRAPHIC PHOTOSENSITIVE MEMBER, A PROCESS-CARTRIDGE INCLUSIVE THEREOF, AND AN IMAGE FORMING APPARATUS

BACKGROUND OF THE INVENTION

1. Field of the Invention

This invention relates to an electrophotographic photosensitive member having a specific surface layer thereupon, a process cartridge containing the electrophotographic photosensitive member, and an image forming apparatus.

2. Related Background Art

The surface of an electrophotographic photosensitive member must be sufficiently durable, because mechanical and electric forces involved in the operation of a charging means, developing means, transferring means and cleaning means are often imposed upon it from outside.

To be more explicit, the surface must be sufficiently durable to withstand wear and damages due to friction, and deteriorating effects by ozone often generating in association with corona charging at high humidity. Further, it is a problem that toner adheres to the surface of the photosensitive member due to repeated developing and cleaning. Therefore, the surface of the photosensitive member must be provided with improved cleaning property.

To provide the surface of the photosensitive member with properties to cope with above problems, surface protective layers containing various resins as their main ingredients on the photosensitive member have been tried. For example, Japanese Patent Application Laid-Open No. 57-30843 proposes a protective layer whose resistance to wear and electric resistance are controlled by the addition of metal oxide particles to act as electro-conductive particles.

Besides, studies have been made to improve the physical properties of the surface of the photosensitive member by adding various materials thereto. Such materials include, to take silicone compounds as an example which have been known to have a low surface energy, silicone oil (Japanese Patent Application Laid-Open No. 61-132954), polydimethylsiloxane, silicone resin powders (Japanese Patent Application Laid-Open No. 4-324454), cross-linked silicone resins, poly(carbonate-silicon) block copolymers, silicon-modified polyurethanes, and silicon-modified polyesters.

The representative polymers which have a low surface energy include fluorine polymers which are represented further by polytetrafluoroethylene powders and carbon fluoride powders.

A surface protective layer comprising a metal oxide or the like tends to have a big surface energy while having a sufficient hardness, and thus it may cause problems of the cleaning property. The silicone resin, though being excellent in having a small surface energy, is not readily compatible to other resins. Therefore, when such a resin is used in an addition system, it tends to agglutinate to cause light scattering, or to bleed upon the surface to locally crystallize there, thereby impairing the stability of the product. The fluorine polymer which is known to have a low surface energy is usually insoluble to solvents and has a poor dispersability. Therefore, the surface of a photosensitive member made from the fluorine polymer may be short in lubricity or smoothness, and, having so small a refraction index as to cause light scattering, in transparency. Further, as the fluorine polymer is usually soft, it is susceptible to mechanical damages.

SUMMARY OF THE INVENTION

An object of this invention is to provide an electrophotographic photosensitive member to cope with said problems, that is, an electrophotographic photosensitive member free from light scattering and bleeding, being uniform, and having a low surface energy and a high resistance both to mechanical and electrical stresses, a process cartridge inclusive thereof, and an image forming apparatus.

To be more concrete, this invention provides an electrophotographic photosensitive member comprising a substrate and a photosensitive layer thereupon, of which a surface layer of the electrophotographic photosensitive member contains a resin that is produced by being subjected to polycondensation as a monomer component only an organosilicon-modified positive hole transporting compound represented by the following formula (I):

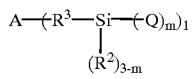

(I)

(where A represents a positive hole transporting group, Q a hydrolyzing group or hydroxyl group, $R^2$ a substituted or unsubstituted, monovalent hydrocarbon group, $R^3$ a substituted or unsubstituted alkylene or arylene group, "m" an integer from 1 to 3, "l" a positive integer, and "m" times "l" is 3 or more).

The present invention also provides a process cartridge and an image forming apparatus, both of which include the electrophotographic photosensitive member.

DETAILED DESCRIPTION OF THE PREFERRED EMBODIMENTS

Figure 1:
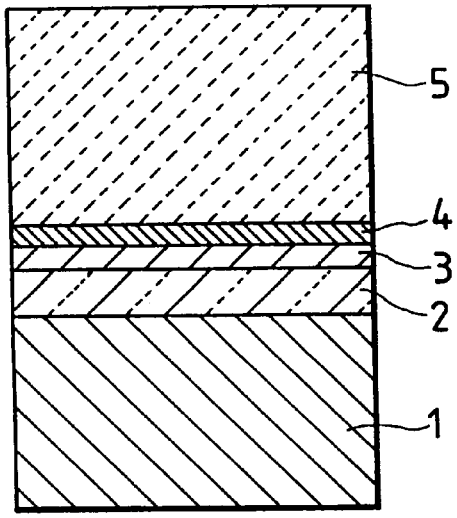
FIG. 1 is a sectional view of an electrophotographic photosensitive member of this invention to illustrate its layer structure.

The surface layer of the electrophotographic photosensitive member of this invention contains a resin which is produced by being subjected to polycondensation as a monomer component only an organosilicon-modified positive hole transporting compound represented by the following formula (I).

(I)

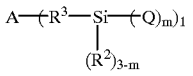

(where A represents a positive hole transporting group, Q a hydrolyzing group or hydroxyl group, $R^2$ a substituted or unsubstituted, monovalent hydrocarbon group, $R^3$ a substituted or unsubstituted alkylene or arylene group, "m" an integer from 1 to 3, "l" a positive integer, and "m" times "l" is 3 or more).

In the present invention, since all monomers in a resin contain a positive hole transporting group, an electrophotographic photosensitive member having very small residual potential can be provided.

In the formula (I), Q represents a hydrolyzing group or hydroxyl group, and such hydrolyzing groups may include methoxy group, ethoxy group, methylethylketoxime group, diethylamino group, acetoxy group, propenoxy group, propoxy group, butoxy group, methoxyethyl group, etc, and they should be preferably represented by —$OR^1$ where $R^1$ is a group forming alkoxy group or alkoxyalkoxy group which acts as a hydrolyzing group and its carbon number should preferably be an integer between 1 and 6, and may include, for example, methyl group, ethyl group, propyl group, butyl group, pentyl group, hexyl group, methoxyethyl group, etc. Q should preferably be alkoxy group represented by the formula of —$OR^1$. Generally speaking, when "m" or the number of the hydrolyzing group bound to the silicon atom is 1 or 2, the organosilicon compound itself will not readily undergo condensation, and polymerization will be inhibited. However, when m is 3, the condensation will readily take place, causing highly the cross-linking reaction. Therefore, the compound with 3 of m will give a satisfactory mechanical strength such as the hardness of the resulting cured product. Therefore, in the present invention, m preferably is 3.

$R^2$ is a monovalent hydrocarbon group directly attached to the silicon atom, and its carbon number should preferably be 1 to 15, and appropriate groups may include, for example, methyl group, ethyl group, propyl group, butyl group, pentyl group, etc. In addition, they may include alkenyl groups such as vinyl group, allyl group, etc., and aryl groups such as phenyl group, tolyl group, etc. The substituent $R^2$ may contain includes, for example, halogen atoms such as fluorine, and the halogen-substituted monovalent hydrocarbon group includes, for example, fluoro hydrocarbon groups represented by trifluoropropyl group, heptafluoropentyl group, nonafluorohexyl group, etc.

$R^3$ represents alkylene group or arylene group, and its carbon number should preferably be 1 to 18, and appropriate group may include, for example, methylene group, ethylene group, propylene group, cyclohexylidene group, phenylene group, biphenylene group, naphtylene group, and other groups which are formed by bonding of those groups. The substituent $R^3$ may contain includes, for example, alkyl groups such as methyl group, ethyl group, etc., aryl groups such as phenyl group, etc., and halogen atoms such as fluorine, chlorine, etc.

Of these, $R^3$ should be preferably represented by the formula —$(CH_2)n$— where n is a positive integer. Still more preferably n should be an integer between 1 and 18, but the groups may not necessarily have a straight chain form. If "n" is not less than 19 ($n \geqq 19$), the positive hole transporting group A will tend to move, and the resulting cured product will tend to have a low hardness. If the positive hole transporting group is directly bonded to the silicon atom, its steric hindrance will cause impairment of the stability and physical properties of the resulting product. "n" should more preferably be 2 to 8. "m" is an integer of 1 to 3, "l" is a positive integer, and "m" times "1" is 3 or more. Further, "l" should preferably be a positive integer between 1 and 5. If "l" is not less than 6 ($l \geqq 6$), unreacted groups will remain after polycondensation reaction, leading to the impairment of electrophotographic properties.

The positive hole transporting property mentioned in this invention refers to the ability to transport positive holes, and should be preferably be 6.2 eV or less in terms of ionizing potential. The organosilicon-modified positive hole transporting compound represented by formula (I) and hydrogen-added A compound should preferably have an ionizing potential of 6.2 eV or less, particularly of 4.5 to 6.2 eV. If the ionizing potential exceeds 6.2 eV, injection of positive holes will become difficult, and the charging will become easy. Conversely, if the ionizing potential is less than 4.5 eV, the compound will readily be oxidized, to be subject to deterioration. Ionizing potential can be measured by photoelectron analysis in the atmosphere (Surface Analysis System AC-1, Riken Keiki).

The organosilicon-modified positive hole transporting compound should preferably have a drift mobility of $1\times10^{-7}$ $cm^2$/V.sec or more as the positive hole transporting ability. If it has a drift mobility of less than $1\times10^{-7}$ $cm^2$/V.sec, is used as an electrophotographic photosensitive material, positive holes will not be able to move sufficiently rapidly in a period between exposure and development, resulting in lowering of apparent sensitivity and leading to elevated residual potential.

The positive hole transporting group A in the formula (I) given above may be any group capable of transporting positive holes, and its hydrogen-addition compounds (positive hole transporting substance) may include, for example, oxazole derivatives, oxadiazole derivatives, imidazole derivatives, triarylamine derivatives such as triphenylamine, 9-(p-diethylaminostyryl)anthracene, 1,1-bis-(4-dibenzylaminophenyl)propane, styrylanthracene, styrylpyrazoline, phenylhydrazones, α-phenylstylbene derivatives, thiazole derivatives, triazole derivatives, phenazine derivatives, acridine derivatives, benzofuran derivatives, benzimidazole derivatives, thiophene derivatives, N-phenylcarbazole derivatives, etc.

The positive hole transporting group A should preferably have a structure represented by the following formula (II).

(II)

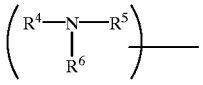

(where $R^4$, $R^5$ and $R^6$ are organic groups, and at least one of them should be an aromatic hydrocarbon cyclic or heterocyclic group, and $R^4$, $R^5$ and $R^6$ may be the same, or different each other.)

As is obvious from the above, the positive hole transporting group A is a group formed by removal of hydrogen atom from one group of $R^4$, $R^5$ and $R^6$.

Preferred examples of $R^4$, $R^5$ and $R^6$ structures will be given below.

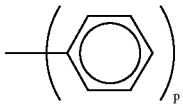
p = 1 to 3
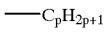
p = 1 to 18
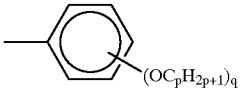
p = 1 to 4,
q = 1 to 3
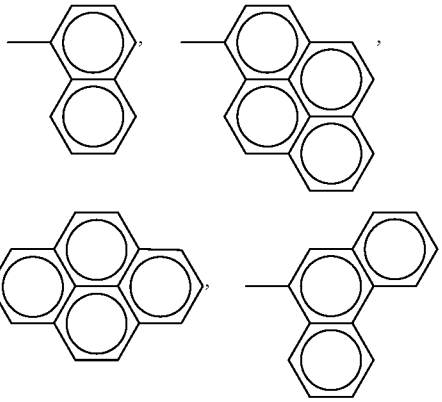
p = 1 to 4,
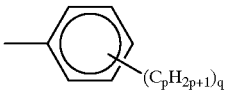
p = 1 to 4,
q = 1 to 3
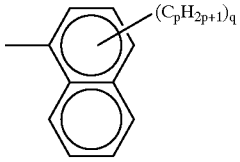
p = 1 to 4,
q = 1 to 3
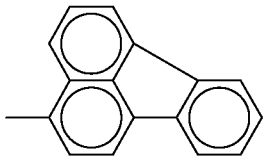
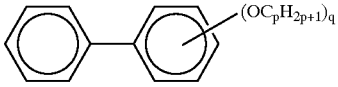
p = 1 to 4,
q = 1 to 3
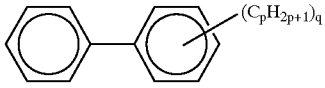
-continued
p = 1 to 4,
q = 1 to 3
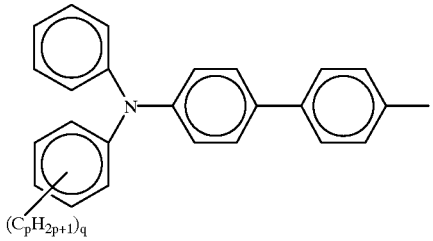
p = 1 to 4,
q = 0 to 3
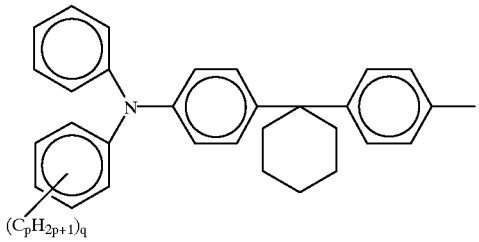
p = 1 to 4,
q = 0 to 3
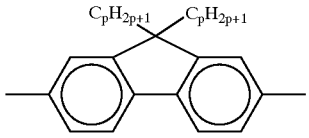
p = 1 to 6
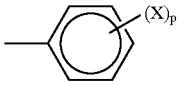
X:Halogen (Cl, F, Br)
p = 1 to 3
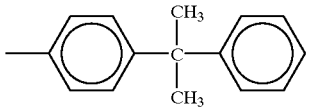
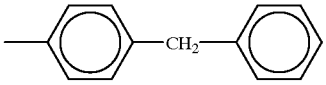
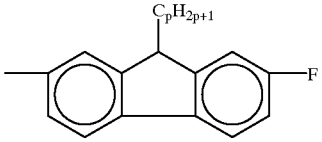
p = 0 to 5
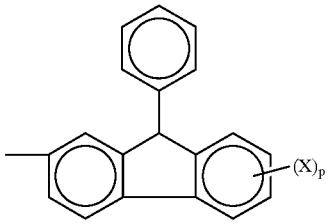
X:Halogen (Cl, F, Br)
p = 0 to 3

-continued

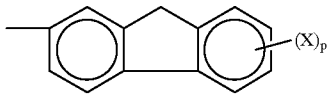

X:Halogen (Cl, F, Br)
p = 0 to 3

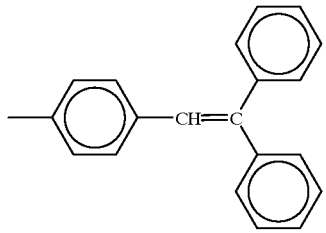

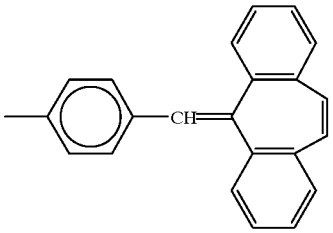

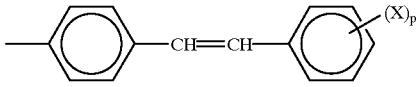

X:Halogen(Cl, F, Br)
p = 0 to 3

To synthesize the organosilicon-modified positive hole transporting compound represented by the above formula (I), a publicly known method, for example, a method whereby a compound having a vinyl group in an aromatic ring and a silicone hydride compound with a substituent are allowed to undergo the hydrosilyl reaction in the presence of a platinum-based catalyst or of an organic peroxide catalyst may be preferably utilized. The platinum catalyst to be used in the method is not limited to any specific ones, but platinum catalysts conventionally used in the hydrosilyl reaction or in the production of addition type silicone rubbers may be profitably used. Thus, appropriate catalysts may include platinum chloride, chloroplatinic acid, platinum-olefin complex, platinum-phosphine complex, etc. No particular limitations are not imposed on the amount of the platinum catalyst, but the amount should be preferably minimized, otherwise the residual catalyst may damage the properties of the compound. When the compound having a vinyl group in an aromatic ring and the silicone hydride compound with a substituent are allowed to undergo the addition reaction in the presence of a platinum-based catalyst or the like to produce a compound of this invention, the reaction may take place at α- or β-position of the vinyl group. Usually, the resulting compound comprises a mixture of the two isomers. The compound used in this invention may include either of the isomers, but when the hydrocarbon group which binds the charge transporting group to the silicon atom has a lower number of carbon, the isomer formed by the reaction at β positionis preferable in terms of the steric hindrance.

The organic peroxide may include any peroxides exhibiting a half life under the environment at room temperature or higher, and particularly alkyl peroxides such as lauryl peroxide may be used preferably because they do not readily extract hydrogens. When a given compound has no vinyl group, formylation is conducted, that is, a formyl group is introduced to the aromatic ring, which is then reduced and dehydrated, or directly subjected to the Wittig reaction, so that the resulting compound may have a vinyl group to be served as a synthetic material for the present invention.

The hydrolysis and polycondensation of the above organosilicon-modified positive hole transporting compound do not require necessarily the presence of a catalyst, but are compatible with the use of catalysts which have been used for the hydrolysis and polycondensation of common silicone resin. When allowance is made for the time and curing temperature required for hydrolysis and polycondensation, alkyltin organic acid salts such as dibutyltin diacetate, dibutyltin dilaurate, dibutyltin octoate, etc. or organic titanate ester such as normal butyl titanate, etc. can be cited as selectable candidates.

In this invention, an organosilicon-modified positive hole transporting compound take, during polycondensation, a three dimensional structure which prevents the movement among the substituting elements and the entry of chemicals from outside, thereby improving the hardness and mechanical strength of the resulting product, and its resistance to wear. Further, the product can be resistive against electric disturbances such as arc discharges often encountered in association with accumulated electric charges, and against chemical damages.

In the present invention, the curing process may be carried out after forming a coating film by a monomer solution, or after forming a coating film after polycondensation of parts of a positive hole transporting compound previously. In the case of previous polycondensation of parts of the positive hole transporting compound, a solution or dispersion solution without disturbance of coating a photosensitive member.

Curing should preferably take place by heating at 100° C. to 200° C. If the temperature is lower than 100° C., the curing reaction takes long, and unreacted hydrolyzing groups may remain after the reaction. If the temperature is higher than 200° C., the hole transporting group tends to deteriorate through oxidation, thus causing disadvantageous problems. More preferably, curing should take place at 120° C. to 160° C.

An example will be given below to show how a curable composition of this invention capable of transporting positive holes can be utilized for the manufacture of an electrophotographic photosensitive member.

Figure 2:
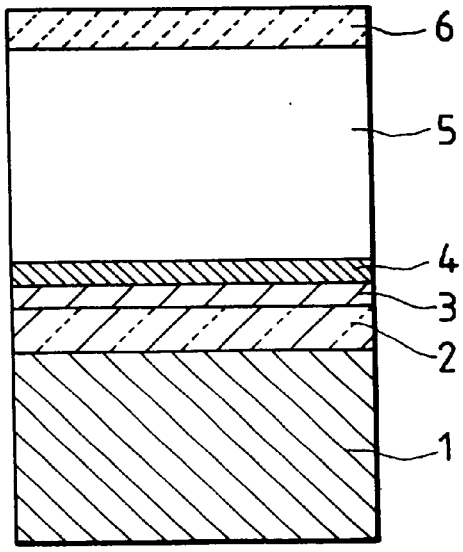
FIG. 2 is a sectional view of another electrophotographic photosensitive member of this invention to illustrate its layer structure.

A substrate (1 in FIGS. 1 and 2) of the electrophotographic photosensitive member can be electroconductive itself and made, for example, of aluminum, aluminum alloys, copper, zinc, stainless steel, chromium, titanium, nickel, magnesium, indium, gold, platinum, silver, iron, etc. Besides, it may be produced after a dielectric substance like plastics has been coated through deposition of aluminum, indium oxide, tin oxide, gold, etc., or it may be produced from a mixture of electroconductive particles with plastics or paper. The electroconductive substrate must have a uniform electroconductivity and a smooth surface. The surface roughness of the substrate should preferably be 0.3 μm or less because the smoothness of the surface has great influence on the uniformity of an undercoat layer, a charge generating layer and a positive hole transporting layer to be formed thereupon. Indentations exceeding 0.3 μm greatly affect local electric fields present in thin layers such as the undercoat and charge generating layers, thus altering the properties of those layers. Then, injection of charges and residual charges would become uneven.

An electroconductive layer (2 in FIGS. 1 and 2) produced by allowing electroconductive particles to disperse into a polymer binder followed by coating the mixture is easy to form, and can readily give a flat, even surface. The primary particle size of the electroconductive particles used for this purpose should be 100 nm or less, or more preferably 50 nm or less. Appropriate electroconductive particles may include electroconductive zinc oxide, electroconductive titanium oxide, Al, Au, Cu, Ag, Co, Ni, Fe, Carbon black, ITO, tin oxide, indium oxide, indium, etc. These may be coated on the surface of insulating particles. The content of said electroconductive particles should be such that the resulting mixture has a sufficiently low volume resistance, preferably $1\times10^{10}$ Ω·cm or less, or more preferably $1\times10^{8}$ Ω·cm or less.

When a coherent light like laser is used as a source to which the photosensitive member is exposed, said electroconductive substrate can have a rough surface to prevent images formed thereupon from being deteriorated through interference. For this purpose, the surface, to be free from problems such as uneven injection of charges and uneven distribution of residual charges, may be allowed to have indentations about ½λ or half the wavelength of the incident light, which is achieved after an insulating material like silica beads of less than several μm in size has been dispersed such that resulting indentations repeat at regular intervals of 10 μm or less.

In the present invention an undercoat layer (3 in FIGS. 1 and 2) capable of intercepting the injection of charges and capable of bonding may be provided between a substrate and a photosensitive layer. The material usable for the undercoat layer may include casein, polyvinylalcohol, nitrocellulose, ethylene-acrylate copolymer, polyvinylbutyral, phenol resins, polyamide, polyurethane, gelatin, etc. The thickness of the undercoat layer should preferably be 0.1 to 10 μm, particularly 0.3 to 3 μm.

A photosensitive layer may have two types: one, or function-separated type comprises a charge generating layer (4 in FIGS. 1 and 2) containing a charge generating material and a charge transporting layer (5 in FIGS. 1 and 2) containing a positive hole transporting material, and the other, or unity type (not illustrated here) comprises a single layer capable of generating and transporting charges at the same location.

Appropriate charge generating materials may include, for example, selenium-tellurium and pyrylium-based dye, thiopyrylium-based dye, phthalocyanine-based pigment, anthanthrone-based pigment, dibenzpyrenequinone-based pigment, pyranthrone-based pigment, trisazo-based pigment, disazo-based pigment, azo-based pigment, indigo-based pigment, quinacrydone-based pigment, cyanin-based pigment, etc.

A resin produced from polycondensation of a compound of this invention capable of transporting positive holes can be used for a charge transporting layer (5 in FIG. 1) or for a surface-protecting layer (6 in FIG. 2) capable of transporting positive holes.

In case of a unity type of photosensitive member, the charge generating substance mentioned above and the compound of this invention capable of transporting positive holes may be combined so that good properties can be obtained.

The compound of this invention capable of transporting positive holes can be used in combination with other positive hole charge transporting substances. Such positive hole transporting substances may include high molecular compounds polymers with a heterocycle or condensed polycyclic aromatic such as poly-N-vinylcarbazole, polystyrylanthracene, etc., and low molecular compounds such as heterocyclic compounds like pyrazoline, imidazole, oxazole, oxadiazole, triazole, carbazole, etc., triarylalkane derivatives like triphenylmethane, phenylenediamine derivatives, N-phenylcarbazole derivatives, stylbene derivatives, hydrazone derivatives, etc.

The charge generating substance or positive hole transporting substance may be supplemented as appropriate with a binder polymer. Appropriate binder polymers may include, for example, polymers or copolymers of vinyl compounds such as styrene, vinyl acetate, vinyl chloride, acrylate ester, methacrylate ester, vinylidene fluoride, trifluoroethylene, and polyvinyl alcohol, polyvinyl acetal, polycarbonate, polyester, polysulfone, polyphenylene oxide, polyurethane, cellulose resins, phenol resins, melamine resins, silicone resins, epoxy resins, etc.

A photosensitive layer and a protective layer of this invention may be supplemented with other additives, in addition to above compounds, to improve mechanical properties or durability of the product. Such additives may include oxidation inhibitors, ultra-violet ray absorbents, stabilizers, crosslinking agent, lubricants, electroconductivity adjusters, etc.

The thickness of the charge generating layer of this invention should preferably be 3 μm or less, particularly 0.01 to 1 μm. The thickness of the charge transporting layer should preferably be 1 to 40 μm, particularly 3 to 30 μm.

When the photosensitive layer is of unity, or monolayer type, its thickness should preferably be 1 to 40 μm, particularly 3 to 30 μm.

The thickness of a surface protecting layer of this invention should preferably be 1 to 15 μm. If it is less than 1 μm, the protection will not be satisfactory. If it exceeds 15 μm, it will add to the overall thickness of the photosensitive layer, thereby causing deterioration in the quality of images.

In the present invention, the product of a spot area an exposure means forms on the photosensitive surface and the thickness or depth of the photosensitive layer within the photosensitive member should preferably be $2\times10^{4}$ $\mu m^3$ or less. Further, this product should be $2\times10^{3}$ $\mu m^3$ or more in terms of the development contrast (potential difference on the photosensitive member during developing). If the product is less than $2\times10^{3}$ $\mu m^3$, sufficient contrast will not be obtained during developing.

In this case, light exposure used in this invention consists of directing light in the form of dots onto a photosensitive member to produce electrostatic latent images there. The light source is not limited to any specific one, but should preferably be a laser or an LED light because they allow easy production of a small light spot area.

Figure 3:
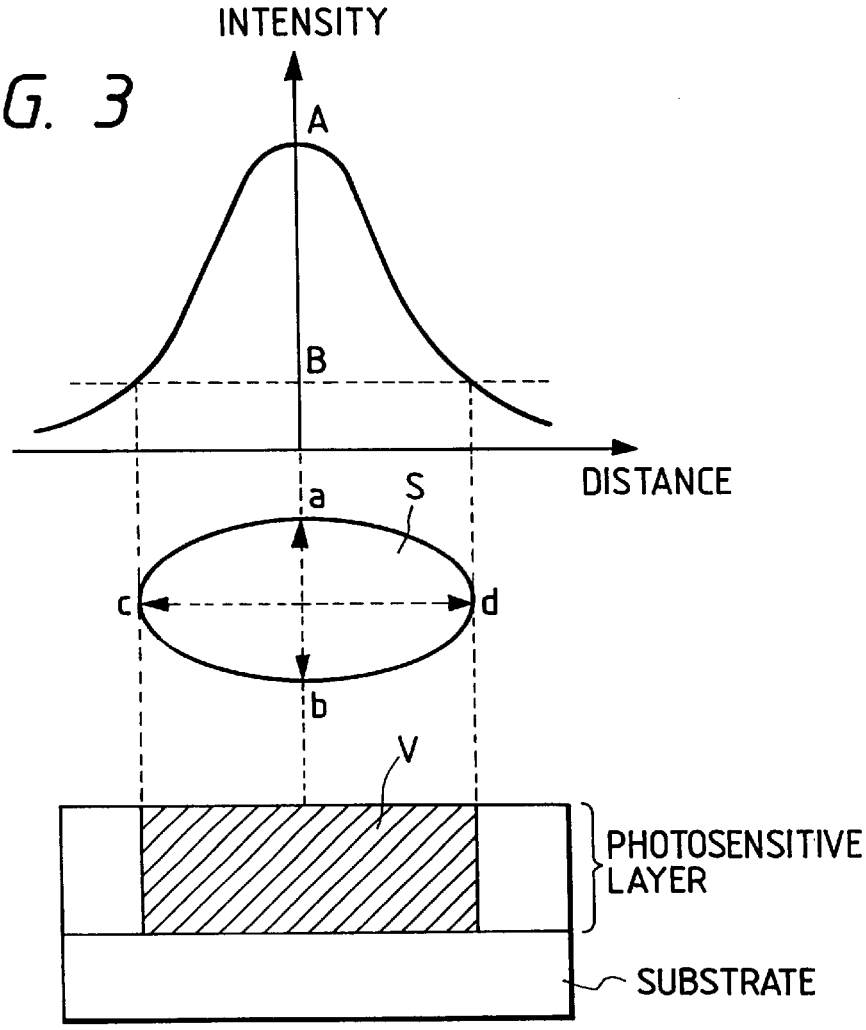
FIG. 3 is a diagram showing the intensity distribution of a spot light, the spot's diameter, the product of the area of the light spot with the thickness of the photosensitive layer, and their relationships.

FIG. 3 gives the intensity distribution of a spot light, the spot's diameter, the product of the area (S) of the light spot with the thickness of the photosensitive layer, and their relationships. The light spot generally has a shape of ellipse comprising a diameter (ab) in the main scanning direction and another diameter (cd) in the subsidiary scanning direction. The product of the area of the light spot and the thickness of the photosensitive layer of this invention represents, so to say, the volume (V) of the photosensitive layer exposed to the light.

The spot area (S) formed by the light represents an area on the photosensitive layer exposed to the light, and corresponds to the area at which the incident light has an intensity of $1/e^2$ (B) of the peak intensity (A), or more. The usable light source may include a semiconductor laser, LED, etc., and the light intensity can take a Gaussian distribution or a Lorenz distribution. In any case, the spot area (S) is defined by the area at which incident light has an intensity of $1/e^2$ (B) of the peak intensity (A), or more. The spot area (S) can be measured by using a CCD camera which is put in place of the photosensitive member.

In this invention, the spot area should preferably be $4\times10^3$ $\mu m^2$ or less, particularly $3\times10^3$ $\mu m^2$ or less. If it exceeds $4\times10^3$ $\mu m^2$, spots of adjacent pixels tend to merge, thus hampering tone reproducibility. The spot area of $1\times10^3$ $\mu m^2$ or more will be beneficial also in terms of cost.

From above considerations, a photosensitive layer of this invention should preferably have a thickness of 12 $\mu$m or less, particularly 10 $\mu$m or less.

An electrophotographic photosensitive member of this invention has an excellent mechanical strength and a good surface lubricity, and is well adapted to be used for above lighting systems.

Figure 4:
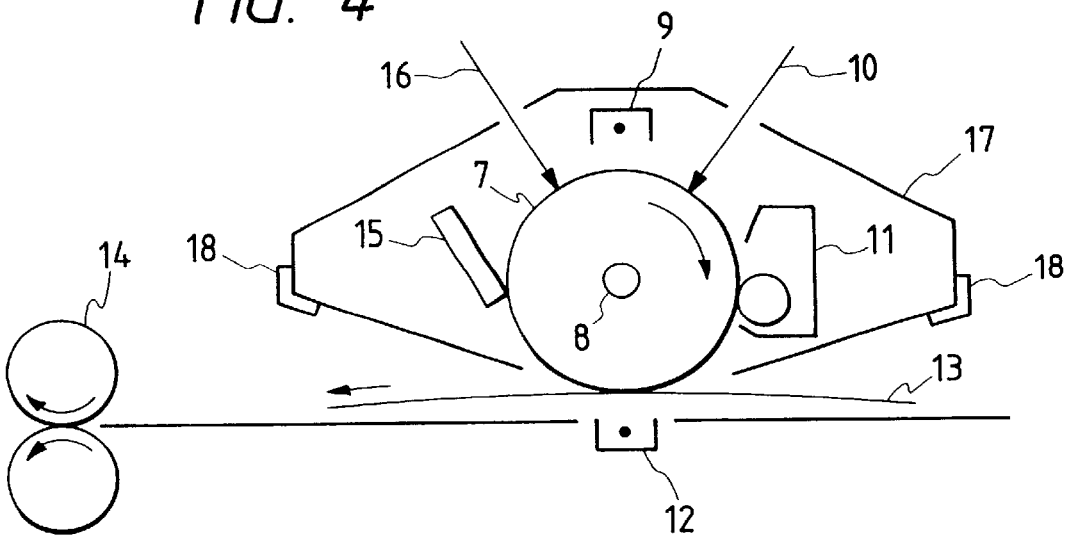
FIG. 4 is a schematic diagram illustrating the simplified structure of a first example of an image forming apparatus of this invention.

FIG. 4 gives a schematic diagram illustrating the simplified structure of a first example of an image forming apparatus having a process cartridge of this invention.

In the figure, 7 is a drum-shaped electrophotograpic photosensitive member of this invention, and is driven into rotation around an axis 8 at a predetermined circumferential speed in the direction the arrow indicates. The photosensitive member 7 receives, during rotation, upon its circumference an even distribution of positive or negative charges having a predetermined potential from a charging means 9. Then, it receives an imagewise exposure light 10 emitted from an imagewise exposure means (not illustrated here) such as laser beam-scanning exposure means, etc. Thus, electrostatic latent images are formed successively on the circumferential surface of the photosensitive member 7.

The electrostatic latent images thus formed are developed with a toner using a developing means 11, and the toner images thus developed are transferred successively by a transferring means 12 to a transfer material 13 which is fed, in synchrony with the rotation of the photosensitive member 7, into between the photosensitive member 7 and a transferring means 12 from a paper feeding section (not illustrated here).

The transfer material 13 having images transferred thereupon is separated from the photosensitive member, and is introduced into a image-fixing means 14 to have the image fixed thereby. The images thus printed on the sheet are discharged from the system as a print-out.

The photosensitive member 7 has its surface cleaned, after transferring of the image, by a cleaning means 15. Thus, the surface is removed of residual toners to be kept clean, and then is removed of residual charges by receiving a priming light 16 from a pre-exposure means (not illustrated here) to be ready for further use to form images. If a primary charging means 9 works through direct contact, for example, by the use of a charging roller, the priming light is not always necessary.

In the present invention, a plurality of such constituent elements as said electrophotographic photosensitive member 7, primary charging means 9, developing means 11 and cleaning means 15 may be united to be installed into a housing to serve as a process cartridge which can be reversibly mounted to an image forming system such as a copying machine, a laser-beam printer, etc. For example, at least one from the primary charging means 9, developing means 11 and cleaning means 15 may be combined with the photosensitive member 7 into a process cartridge 17, which, then, may be reversibly mounted to a main system by sliding on a pair of rails 18 prepared therein.

Figure 5:
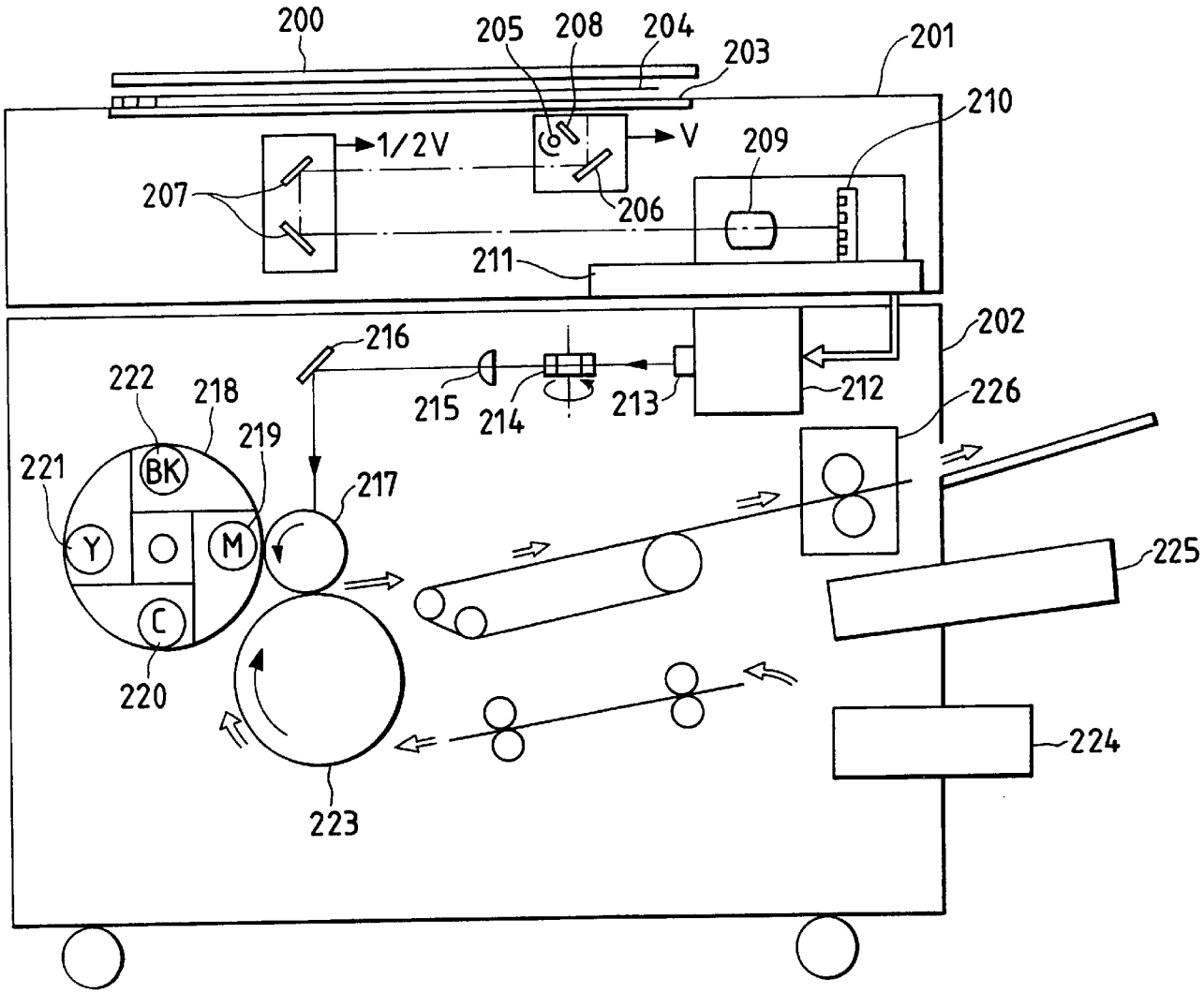
FIG. 5 is a schematic diagram illustrating the simplified structure of a second example of an image forming apparatus of this invention.

FIG. 5 gives a schematic diagram illustrating the simplified structure of a second example of an image forming apparatus of this invention, or a color copying machine.

In the figure, numeral 201 represents an image scanner section which reads a manuscript and translates it into digital signals. Numeral 202 is a printer section which prints, onto a sheet of paper, an image in full color corresponding to the original image read by the image scanner 201.

With regard to the image scanner section 201, 200 is a mirror-faced thick plate, a manuscript 204 is placed on a manuscript glass plate 203, and the manuscript is exposed to light which has been generated by a halogen lamp 205 and allowed to pass through a filter 208 intercepting infra-red lights. The light reflected from the manuscript is guided to mirrors 206 and 207, and through a mirror 209 to be focused onto a 3 line sensor (CCD) 210. The CCD 210 color-analyses an optical information from an original, and the full color information comprising red (R), green (G) and blue (B) components is sent to a signal processing section 211. 205 and 206 are mechanically driven at a velocity of v, and 207 at a velocity of ½v in the direction vertical (in the subsidiary scanning direction) to the direction (main scanning direction) towards which the line sensor is driven electrically, thereby scanning the whole surface of the manuscript.

The signal processing section 211 electrically processes signals read from the manuscript, decomposes them into individual components such as magenta (M), cyan (C), yellow (Y) and black (BK), which are then transferred to a printer section 202, thus whenever a manuscript is scanned four times in succession, one printout is dispatched.

M, C, Y and BK image signals delivered by the image scanner section 201 are carried to a laser driver 212 which modulates a semiconductor laser generator 213 according to the image signals. Laser light, passing through a polygon mirror 214, an f-θ lens 215 and a mirror 216, scans the surface of a photosensitive member 217.

218 is a rotatory developer and comprises a magenta developer 219, a cyan developer 220, a yellow developer 221, and a black developer 222 in such a way that the four developers come into contact with the photosensitive member in succession, and develop M, C, Y and BK electrostatic latent images which are formed on the photosensitive member 217 with the corresponding toners.

Numeral 223 denotes a transferring drum, round which a sheet of paper fed from a paper cassette 224 or 225 is wound, and whereby the toner image developed on the photosensitive member 217 is transferred onto the sheet of paper.

Through such mechanism, four colors represented by M, C, Y and BK are transferred in succession onto the sheet of paper which then is passed through a fixing unit 226 to be discharged from the system.

SYNTHESIS EXAMPLE 1

Synthesis of 4-[2-(triethoxysilyl)ethyl] triphenylamine

Synthesis of 4-(N,N-diphenylamino)benzaldehyde

Into a three-necked flask, 101.4 g of triphenylamine and 35.5 ml of DMF (dimethylformamide) were placed, and 84.4 ml of phosphorus oxychloride was added dropwise thereto with stirring while cooling with ice water, and then the temperature was raised to 95° C. to carry out reaction for 5 hours. The reaction solution obtained was poured into 4 liters of warm water, followed by stirring for 1 hour. Thereafter, the precipitate formed was collected by filtration, and washed with a mixture of ethanol/water (1:1) to obtain 4-(N,N-diphenylamino)benzaldehyde in an amount of 91.5 g (yield: 81.0%).

Synthesis of 4-vinyltriphenylamine

Into a three-necked flask, 14.6 g of sodium hydride and 700 ml of 1,2-dimethoxyethane were placed, and 130.8 g of trimethylphosphonium bromide was added thereto with stirring at room temperature. Next, after a drop of absolute alcohol was added, the reaction was allowed to proceed at 70° C. for 4 hours. Then, 100 g of 4-(N,N-diphenylamino) benzaldehyde was added thereto, and the temperature was raised to 70° C. to carry out reaction for 5 hours. The resulting reaction solution was filtered, and the filtrate and an ether-extract of the precipitate were put together and washed with water. Then, the ether solution was dehydrated with calcium chloride, and ether was removed to obtain a crude reaction product. After recrystallized from ethanol, acicular pale yellow vinyltriphenylamine was obtained in an amount of 83.4 g (yield: 84.0%).

Hydrosilylation of 4-vinyltriphenylamine

Into a three-necked flask, 40 ml of toluene, 9.9 g (60 mmol) of triethoxysilane and 0.018 mmol of diplatinum (0) tris(tetramethyldivinyldisiloxane) in toluene were placed, and 20 ml of a toluene solution containing 8.2 g of 4-vinyltriphenylamine was added dropwise with stirring at room temperature. After the addition was completed, the mixture was stirred at 70° C. for 3 hours, and thereafter the solvent was removed under reduced pressure to obtain oily pale yellow 4-[2-(triethoxysilyl)ethyl]triphenylamine in an amount of 12.1 g (yield: 91.7%).

Figure 6:
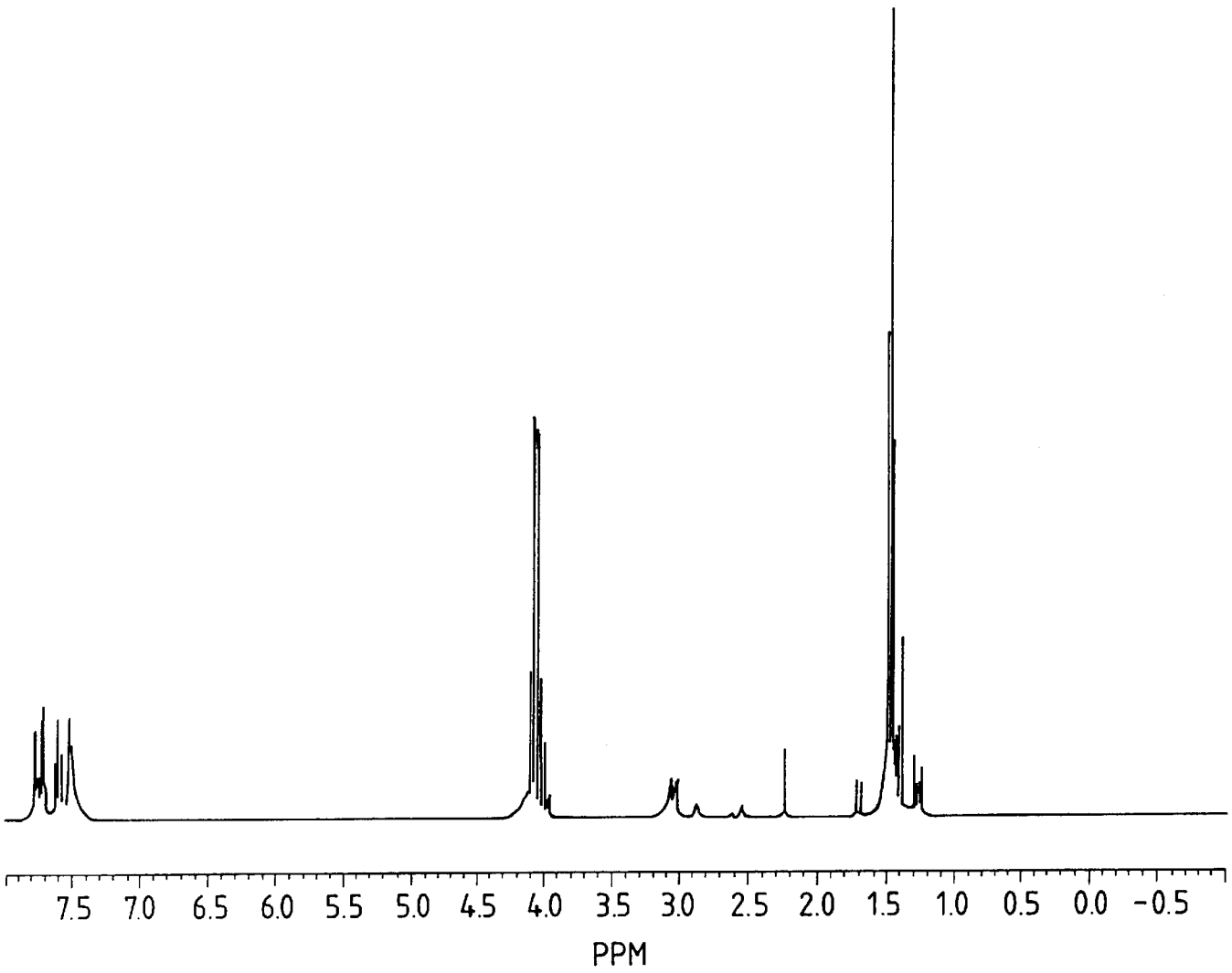
FIG. 6 is a H-NMR spectrum of 4-[2-(triethoxysilyl) ethyl]triphenylamine in Synthesis Example 1.

An H-NMR spectrum (measured by APC300, an NMR spectrometer manufactured by Bruker Co.) of the compound is shown in FIG. 6.

Ionization potential of this compound measured by atmospheric photoelectron analysis (using a surface analyzer AC-1, manufactured by Riken Keiki K.K.) was 5.68 eV.

This compound was applied onto a substrate of copper by the wirebar coat method and subjected to thermal curing treatment at 120° C. for 12 hours to form a film of about 8 μm. Next, a semi-transparent electrode of gold was formed by the vapor deposition.

The drift mobility of this sample was measured by the Time-of-flight method using a nitrogen laser with a pulse width of 3 nsec. and a wavelength of 337 nm and found to be $1\times10^{-7}$ $cm^2$/Vsec.

SYNTHESIS EXAMPLE 2

Synthesis of 4,4'-bis[2-(triethoxysilyl)ethyl] triphenylamine

Synthesis of N,N-bis(4-formylphenyl)aminobenzene

Into a three-necked flask, 50.7 g of triphenylamine and 35.5 ml of DMF were placed, and 84.4 ml of phosphorus oxychloride was added dropwise thereto with stirring while cooling with ice water. After the addition was completed, the mixture solution was heated to 95° C. to carry out reaction for 5 hours. The reaction solution obtained was poured into 5 liter of warm water, followed by stirring for 1 hour. Thereafter, the precipitate formed was collected by filtration, and washed with a mixture of ethanol/water (1:1) to obtain N,N-bis(4-formylphenyl)aminobenzene in an amount of 65.3 g (yield: 95.9%).

Synthesis of N,N-bis(4-vinylphenyl))aminobenzene

Into a three-necked flask, 4.8 g of sodium hydride and 700 ml of 1,2-dimethoxyethane were placed, and 73.2 g of methyltriphosphonium bromide was added thereto with stirring at room temperature. Next, after a drop of absolute ethanol was added, the reaction was allowed to proceed at 70° C. for 4 hours. Then, 30.0 g of N,N-bis(4-formylphenyl) aminobenzene was added to the mixture thus obtained, to carry out reaction at 70° C. for 5 hours. The reaction solution obtained was washed with water. The toluene extract of the solution was carried out. Then, the toluene solution was dehydrated with calcium chloride, and thereafter solvent was removed to obtain pale yellow N,N-bis(4-vinylphenyl) aminobenzene was obtained in an amount of 18.4 g (yield: 62.2%).

Hydrosilylation of N,N-bis(4-vinylphenyl)aminobenzene

Into a three-necked flask, 40 ml of toluene, 9.9 g (60 mmol) of triethoxysilane and 0.018 mmol of diplatinum (0) tris(tetramethyldivinyldisiloxane) in toluene were placed, and 20 ml of a toluene solution containing 2.6 g (8.7 mmol) of N,N-bis(4-vinylphenyl)aminobenzene was added dropwise with stirring at room temperature. After the addition was completed, the mixture was stirred at 70° C. for 3 hours, and thereafter the solvent was removed under reduced pressure to obtain oily pale yellow 4,4'-bis[2-(triethoxysilyl)-ethyl]triphenylamine in an amount of 4.4 g (yield: 80.6%).

Ionization potential of this compound measured by atmospheric photoelectron analysis (using a surface analyzer AC-1, manufactured by Riken Keiki K.K.) was 5.67 eV.

This compound was applied onto a substrate of copper by the wirebar coat method and subjected to thermal curing treatment at 120° C. for 12 hours to form a film of about 5 μm. Next, a semi-transparent electrode of gold was formed by the vapor deposition.

The drift mobility of this sample was measured by the Time-of-flight method using a nitrogen laser with a pulse width of 3 nsec. and a wavelength of 337 nm and found to be $3\times10^{-7}$ $cm^2$/Vsec.

SYNTHESIS EXAMPLE 3

Synthesis of 4-[N,N-bis(3,4-dimethylphenyl) amino]-[2-(triethoxysilyl)ethyl]benzene Synthesis of N,N-bis(3,4-dimethylphenyl)aminobenzene To 20 ml of nitrobenzene, 38.5 g (166 mmol) of 4-iodo-o-xylene, 22.9 g (166 mmol) of anhydrous potassium carbonate and 7.0 g of copper powder were added, followed by heating and reflux for 8 hours with stirring. The reaction mixture was cooled and filtered, and the precipitate was removed. The filtrate (crude reaction product) was passed through a silica gel column to obtain 15.7 g of N,N-bis(3,4-dimethylphenyl)aminobenzene (yield: 69%).

Synthesis of 4-[N,N-bis(3,4-dimethylphenyl)amino] benzaldehyde

Into a three-necked flask, 124.6 g of [N,N-bis(3,4-dimethylphenyl)amino]benzene and 35.5 ml of DMF were placed, and 84.4 ml of phosphorus oxychloride was added dropwise thereto with stirring while cooling with ice water. After the addition was completed, the mixture solution was heated to 95° C. to carry out reaction for 5 hours. The reaction solution obtained was poured into 4 liters of warm water, followed by stirring for 1 hour. Thereafter, the precipitate was collected by filtration, and washed with a mixture of ethanol/water (1:1) to obtain 4-[N,N-bis(3,4-dimethylphenyl)amino]benzaldehyde in an amount of 107.6 g (yield: 79.0%).

Synthesis of 4-[N,N-bis(3,4-dimethylphenyl)amino]styrene

Into a three-necked flask, 12.1 g of sodium hydride and 580 ml of 1,2-dimethoxyethane were placed, and 108.5 g of trimethylphosphonium bromide was added thereto with stirring at room temperature. Next, after a drop of absolute alcohol was added, the reaction was allowed to proceed at 70° C. for 4 hours. Then, 100.0 g of 4-[N,N-bis(3,4-dimethylphenyl)amino]benzaldehyde was added to the reaction mixture, to carry out reaction at 700° C. for 5 hours, followed by filtration to collect a cake. The cake was extracted with ether and the extract was put together with the filtrate and washed with water. Then, the ether solution was dehydrated with calcium chloride, and thereafter the ether was removed to obtain a crude product. After twice recrystallized from ethanol, acicular 4-[N,N-bis(3,4-dimethylphenyl)amino]styrene was obtained in an amount of 84.5 g (yield: 85.0%).

Hydrosilylation of 4-[N,N-bis(3,4-dimethylphenyl)amino] styrene

Into a three-necked flask, 40 ml of toluene, 6.0 g of triethoxysilane and 0.54 mmol of diplatinum (0) tris (tetramethyldivinyldisiloxane) in toluene were placed, and 20 ml of a toluene solution containing 9.9 g of 4-[N,N-bis (3,4-dimethylphenyl)amino]styrene was added dropwise with stirring at room temperature. After the addition was completed, the mixture was stirred at 70° C. for 3 hours, and thereafter the solvent was removed under reduced pressure to obtain oily pale yellow 4-[N,N-bis(3,4-dimethylphenyl) amino]-[2-(triethoxysilyl)ethyl]benzene in an amount of 13.4 g (yield: 90.1%).

Figure 7:
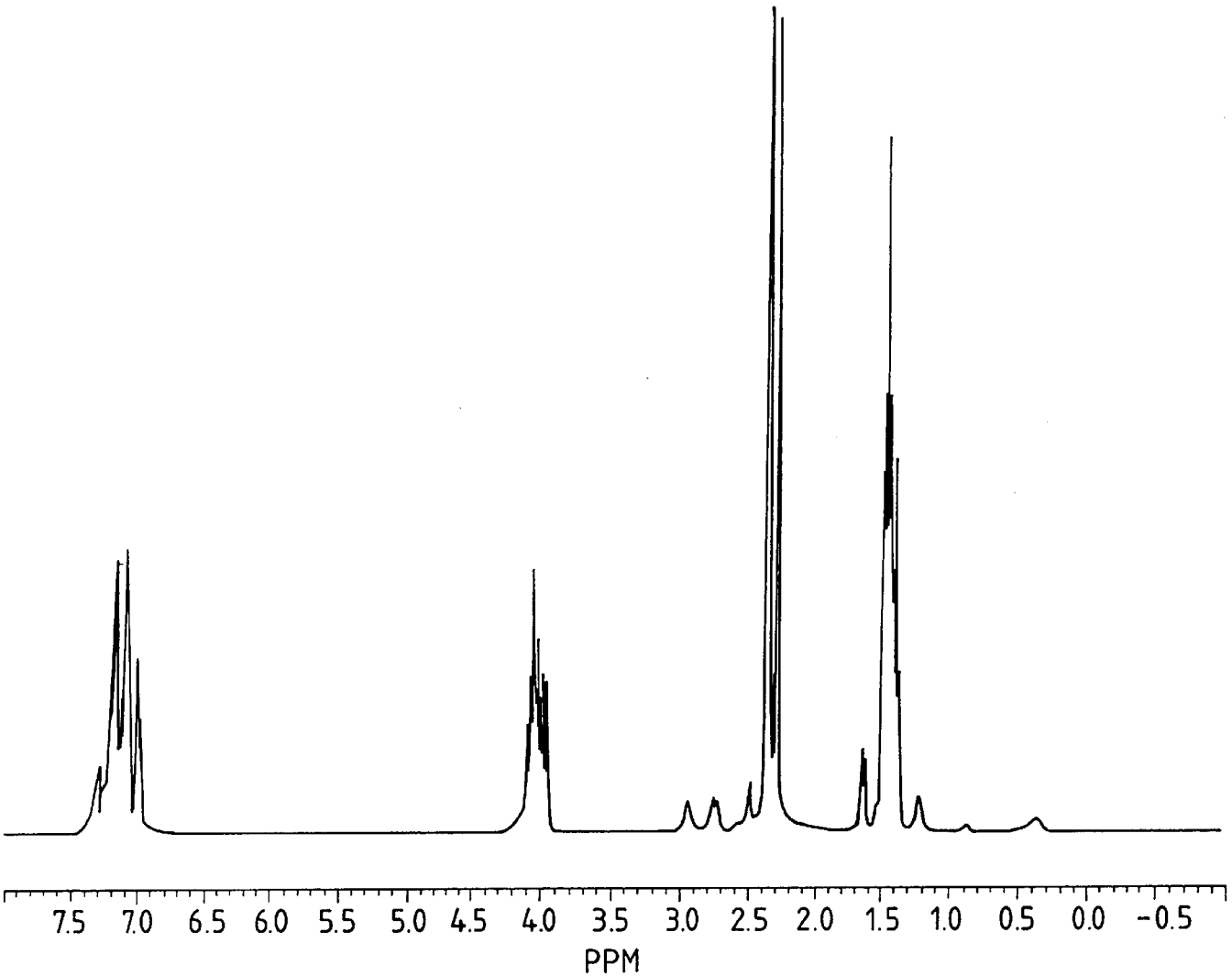
FIG. 7 is a H-NMR spectrum of 4-[N,N-bis(3,4-dimethylphenyl)amino]-[2-(triethoxysilyl)ethyl]benzene in Synthesis Example 3.
Figure 8:
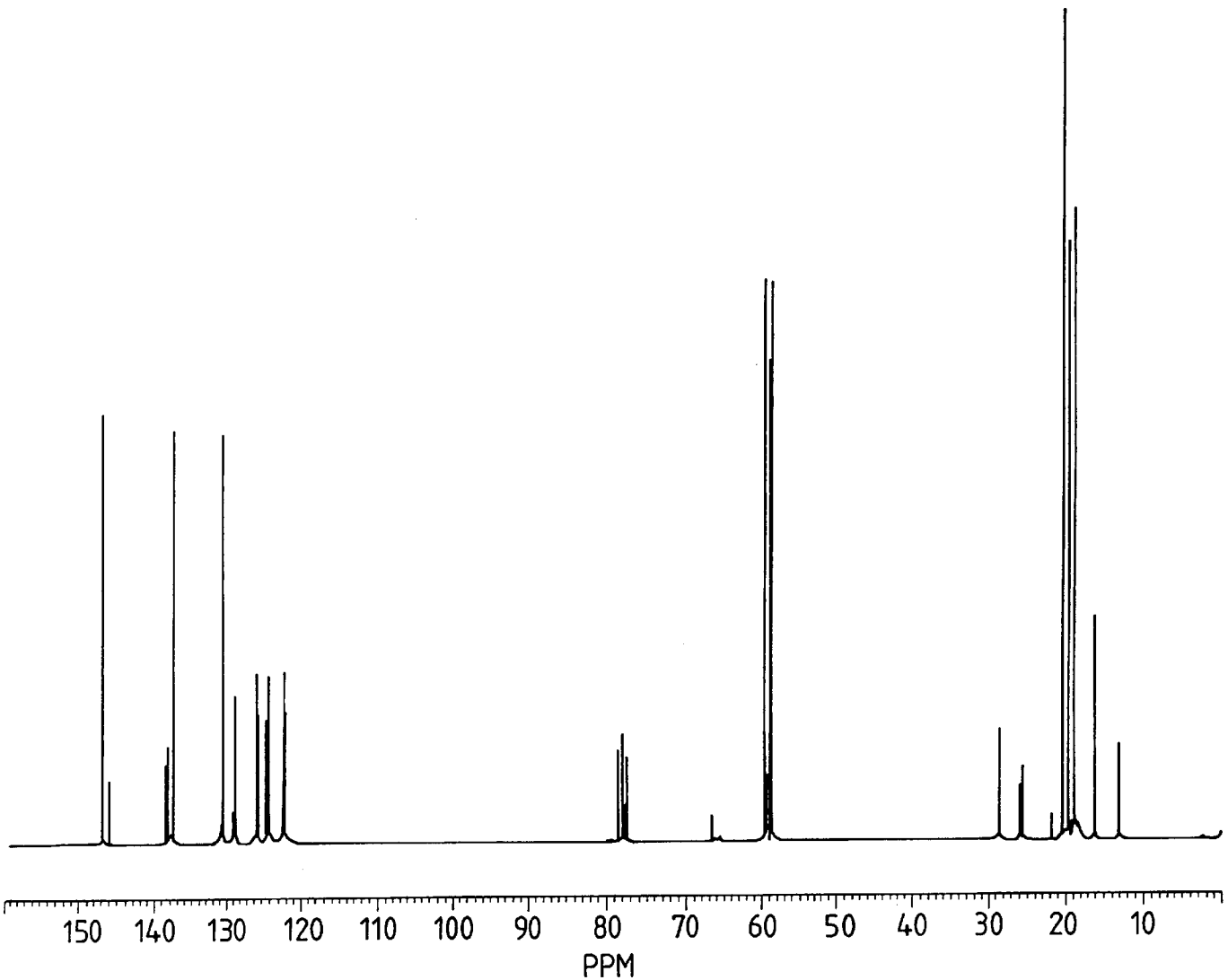
FIG. 8 is a C-NMR spectrum of 4-[N,N-bis(3,4-dimethylphenyl)amino]-[2-(triethoxysilyl)ethyl]benzene in Synthesis Example 3.

An H-NMR spectrum (measured by APC300, an NMR spectrometer manufactured by Bruker Co.) of the compound obtained is shown in FIG. 7. A C-NMR spectrum (measured by APC300, an NMR spectrometer manufactured by Bruker Co.) of the product compound is shown in FIG. 8.

Ionization potential of this compound measured by atmospheric photoelectron analysis (using a surface analyzer AC-1, manufactured by Riken Keiki K.K.) was 5.26 eV.

This compound was applied onto a substrate of copper by the wirebar coat method and subjected to thermal curing treatment at 120° C. for 12 hours to form a film of about 5 μm. Next, a semi-transparent electrode of gold was formed by the vapor deposition.

The drift mobility of this sample was measured by the Time-of-flight method using a nitrogen laser with a pulse width of 3 nsec. and a wavelength of 337 nm and found to be $9\times10^{-7}$ $cm^2/Vsec$.

SYNTHESIS EXAMPLE 4

Synthesis of 4-[N,N-bis(3,4-dimethylphenyl) amino]-[2-(triethoxysilyl)ethyl]benzene Hydrosilylation of 4-[N,N-bis(3,4-dimethylphenyl)amino] styrene Into a three-necked flask, 40 ml of toluene, 6.0 g (37 mmol) of triethoxysilane and 0.34 mmol of platinum (II) dichloro(h-cycloocta-1,5-diene) were placed, and 20 ml of a toluene solution containing 9.9 g of 4-[N,N-bis(3,4-dimethylphenyl)amino]styrene was added dropwise with stirring at room temperature. After the addition was completed, the mixture was stirred at 70° C. for 3 hours, and thereafter the solvent was removed under reduced pressure to obtain oily pale yellow 4-[N,N-bis(3,4-dimethylphenyl) amino]-[2-(triethoxysilyl)ethyl]benzene in an amount of 14.0 g (yield: 94.2%).

Ionization potential of this compound measured by atmospheric photoelectron analysis (using a surface analyzer AC-1, manufactured by Riken Keiki K.K.) was 5.31 eV.

This compound was applied onto a substrate of copper by the wirebar coat method and subjected to thermal curing treatment at 120° C. for 12 hours to form a film of about 5 μm. Next, a semi-transparent electrode of gold was formed by the vapor deposition.

The drift mobility of this sample was measured by the Time-of-flight method using a nitrogen laser with a pulse width of 3 nsec. and a wavelength of 337 nm and found to be $7\times10^{-7}$ $cm^2/Vsec$.

SYNTHESIS EXAMPLE 5

Synthesis of 4-[3-(triethoxysilyl)propyl] triphenylamine

Synthesis of 4-bromotriphenylamine

Into a 200 ml three-necked flask, 8.0 g (45 mmol) of N-bromosuccinimide and 10.0 g (41 mmol) of triphenylamine were placed, followed by 150 ml of N,N-dimethylformamide. The mixture was stirred overnight at room temperature. Next, N,N-dimethylformamide was removed from the reaction, and the resulting solid matter was extracted with carbon tetrachloride. Then, carbon tetrachloride was removed, and the reaction product was recrystallized twice from ethanol to give a white solid, 4-bromotriphenylamine in an amount of 8.2 g (yield: 61.7%).

Synthesis of 4-N,N-diphenylaminoallylbenzene

Into a 300 ml four-necked flask, 1.0 g (40 mmol) of magnesium metal was placed, and the space air was replaced with nitrogen. Subsequently, 100 ml of diethyl ether was added and stirring was started. To the mixture being stirred, 30 ml of diethyl ether solution dissolving 8.6 g (27 mmol) of 4-bromotriphenylamine was slowly added dropwise. When about 3 ml of the 4-bromotriphenylamine solution was added dropwise, reflux slowly began. While being refluxed, the remaining 4-bromotriphenylamine solution was added dropwise. After the addition was completed, the reflux was further continued for 1 hour to obtain a Grignard reagent solution. The reagent solution thus obtained was cooled to room temperature, and then 40 ml of a diethyl ether solution containing 2.1 g (27 mmol) of allyl chloride was slowly added dropwise while cooling with ice. After the addition was completed, the reaction mixture was refluxed for 2 hours to age the reaction. Thereafter, 50 ml of water was added while cooling with ice, to effect hydrolysis. Next, the ether layer was collected, washed once with a saturated aqueous sodium hydrogencarbonate solution and washed twice with water, and then dried with anhydrous sodium sulfate. After drying, diethyl ether was removed to obtain a white solid, 4-N,N-diphenylaminoallylbenzene in an amount of 4.9 g (yield: 63.2%).

Hydrosilylation of 4-N,N-diphenylaminoallylbenzene

Into a three-necked flask, 40 ml of toluene, 6.0 g (37 mmol) of triethoxysilane and 0.54 mmol of diplatinum (0) tris(tetramethyldivinyldisiloxane) in toluene were placed, and 20 ml of a toluene solution containing 9.7 g (34 mmol) of 4-N,N-diphenylaminoallylbenzene was added dropwise with stirring at room temperature. After the addition was completed, the mixture was stirred at 70° C. for 3 hours, and thereafter the solvent was removed under reduced pressure to obtain oily pale yellow 4-[3-(triethoxysilyl)propyl] triphenylamine in an amount of 10.7 g (yield: 70.1%).

Ionization potential of this compound measured by atmospheric photoelectron analysis (using a surface analyzer AC-1, manufactured by Riken Keiki K.K.) was 5.72 eV.

This compound was applied onto a substrate of copper by the wirebar coat method and subjected to thermal curing treatment at 120° C. for 12 hours to form a film of about 9 μm. Next, a semi-transparent electrode of gold was formed by the vapor deposition.

The drift mobility of this sample was measured by the Time-of-flight method using a nitrogen laser with a pulse width of 3 nsec. and a wavelength of 337 nm and found to be $1.4\times10^{-7}cm^2/Vsec$.

SYNTHESIS EXAMPLE 6

Synthesis of 4-[4-(triethoxysilyl)butyl] triphenylamine

Synthesis of 4-methyltriphenylamine

To 30 ml of o-dichlorobenzene, 4.5 g (27 mmol) of diphenylamine, 11.0 g (51 mmol) of p-iodotoluene, 5.5 g (40 mmol) of anhydrous sodium carbonate and 1.1 g of copper powder were added. The mixture was heated and refluxed with stirring for 7 hours. After the reaction was completed, the reaction solution was filtered. The filtrate was successively washed with an aqueous 3 to 5% sodium thiosulfate solution and saturated brine. The organic layer was dried with anhydrous sodium sulfate, and thereafter the solvent was removed. The resulting crude reaction product was recrystallized from ethanol to obtain 4-methyltriphenylamine in an amount of 5.7 g (yield: 81.4%).

Synthesis of 4-bromomethyltriphenylamine

Into a 300 ml three-necked flask, 6.9 g (39 mmol) of N-bromosuccinimide and 9.1 g (35 mmol) of 4-methyltriphenylamine were placed, and 100 ml of carbon tetrachloride was added thereto. Thereafter, the mixture was heated and refluxed overnight with stirring. After the reaction was completed, the reaction solution was cooled. Subsequently, the reaction was filtered, and the solvent was removed. The reaction product thus obtained was recrystallized from ethanol to obtain 4-bromomethyltriphenylamine in an amount of 10.8 g (yield: 91.2%).

Synthesis of 4-N,N-diphenylaminophenyl-1-butene

Into a 200 ml four-necked flask, 1.0 g (40 mmol) of magnesium metal was put, and the space air of the flask was replaced with nitrogen. Subsequently, 100 ml of diethyl ether was added and stirring was started. To the mixture, 20 ml of a diethyl ether solution in which 9.1 g (27 mmol) of 4-bromomethyltriphenylamine was dissolved was slowly added dropwise with stirring. When about 5 ml of the solution was added dropwise, reflux slowly started. While being refluxed, the remaining solution of 4-bromomethyltriphenylamine was added dropwise. After the addition was completed, the reflux was further continued for 1 hour to obtain a Grignard reagent solution. The reagent solution thus obtained was cooled to room temperature, and then 20 ml of a diethyl ether solution of 2.1 g (27 mmol) of allyl chloride was slowly added dropwise while cooling with ice. After the addition was completed, the reaction mixture was refluxed for 2 hours to age the reaction. Thereafter, 50 ml of water was added while cooling with ice, to effect hydrolysis. Next, the ether layer formed was collected, washed once with a saturated aqueous sodium hydrogencarbonate solution and twice with water, and then dried with anhydrous sodium sulfate. After drying, diethyl ether was removed to obtain a white solid, 4-N,N-diphenylaminophenyl-1-butene in an amount of 5.5 g (yield: 66.7%).

Hydrosilylation of 4-N,N-diphenylaminophenyl-1-butene

Into a three-necked flask, 40 ml of toluene, 9.9 g (60 mmol) of triethoxysilane and 0.018 mmol of diplatinum (0) tris(tetramethyldivinyldisiloxane) in toluene were placed, and 20 ml of a toluene solution containing 16.7 g (54.7 mmol) of 4-N,N-diphenylaminophenyl-1-butene was added dropwise with stirring at room temperature. After the addition was completed, the mixture was stirred at 70° C. for 3 hours, and thereafter the solvent was removed under reduced pressure to obtain oily pale yellow 4-[4-(triethoxysilyl) butyl]triphenylamine in an amount of 13.9 g (yield: 83.2%).

Ionization potential of this compound measured by atmospheric photoelectron analysis (using a surface analyzer AC-1, manufactured by Riken Keiki K.K.) was 5.69 eV.

This compound was applied onto a substrate of copper by the wirebar coat method and subjected to thermal curing treatment at 120° C. for 12 hours to form a film of about 5 μm. Next, a semi-transparent electrode of gold was formed by the vapor deposition.

The drift mobility of this sample was measured by the Time-of-flight method using a nitrogen laser with a pulse width of 3 nsec. and a wavelength of 337 nm and found to be $2\times10^{-7}$ $cm^2/Vsec$.

SYNTHESIS EXAMPLE 7

10 g of 4-[2-(triethoxysilyl)ethyl]triphenylamine (Synthesis Example 1) was dissolved to 16.7 g of toluene, and 0.2 g of dibutyltin acetate was added to the mixture and mixed. The mixture was applied on a glass plate by means of a bar coater, followed by drying at 140° C. for 15 hours. Under microscopic observation, a uniform film had been formed.

COMPARATIVE SYNTHESIS EXAMPLE 1

10 g of methyltriethoxysilan was dissolved to 16.7 g of toluene, triphenylamine was dissolved as a positive hole transporting compound in an amount of 30% by weight based on the weight of methyltriethoxysilane, and 0.2 g of dibutyltin diacetate was added to the mixture and mixed, followed by mixing and curing in the same manner as in Synthesis Example 7 to form a film. The film was cloudy, and microscopic observation confirmed deposition of triphenylamine.

COMPARATIVE SYNTHESIS EXAMPLE 2

The procedure of Comparative Synthesis Example 1 was repeated to form a film, except that phenyltriethoxysilane was used instead of using methyltriethoxysilane. The film formed was less opaque, but microscopic observation confirmed deposition of crystals of triphenylamine.

COMPARATIVE SYNTHESIS EXAMPLE 3

The procedure of Synthesis Example 1 was repeated to obtain 4-[2-(trimethylsilyl)ethyl]triphenylamine, except that 6 g (60 mmol) of trimethylsilane was used in the hydrosilylation. Using this as a charge transporting compound, a film was formed in the same manner as in Comparative Synthesis Example 1. As a result, the film was opaque, and separation of 4-[2-(trimethylsilyl)ethyl]triphenylamine was observed.

COMPARATIVE SYNTHESIS EXAMPLE 4

10 g of methyltriethoxysilane was dissolved to 16.7 g of toluene, triarylamine used in Example 1 as mentioned below was dissolved as a charge transporting compound in an amount of 30% by weight based on the weight of methyltriethoxysilane, and followed by mixing and curing in the same manner as in Synthesis Example 7 to form a film. The film was cloudy, and microscopic observation confirmed deposition of triarylamine compound.

SYNTHESIS EXAMPLE 8

Synthesis of 4-(N-ethyl-N-phenylamino)-[2-(triethoxysilyl)ethyl]benzene

Synthesis of 4-(N-ethyl-N-phenylamino)benzaldehyde

Into a three-necked flask, 82 g of diphenylethylamine and 35.5 ml of DMF were added, and 84.4 ml of phosphorus oxychloride was added dropwise thereto with stirring while cooling with ice water. After the addition was completed, the temperature was raised to 95° C. to carry out reaction for 5 hours. Thereafter, the resulting precipitate was collected by filtration, and washed with a mixture of ethanol/water (1:1) to obtain 4-(N-ethyl-N-phenylamino)benzaldehyde in an amount of 62 g.

Synthesis of 4-(N-ethyl-N-phenylamino)styrene

Into a three-necked flask, 14.6 g of sodium hydride and 700 ml of 1,2-dimethoxyethane were placed, and 130.8 g of trimethylphosphonium bromide was added thereto with stirring at room temperature. Next, after a drop of absolute alcohol was added, the reaction was allowed to proceed at 70° C. for 5 hours. The reaction solution was filtered, and the filtrate and an ether-extract of the precipitate were put together, followed by washing with water. Then, the ether fraction was dehydrated with calcium chloride, and thereafter the ether was removed to obtain a crude reaction product. The reaction product was recrystallized from ethanol to obtain acicular pale yellow crystals in an amount of 62.4 g.

Hydrosilylation of 4-(N-ethyl-N-phenylamino)styrene

Into a three-necked flask, 40 ml of toluene, 9.9 g (60 mmol) of triethoxysilane and 0.018 mmol of diplatinum (0) tris(tetramethyldivinyldisiloxane)in toluene were placed, and 20 ml of a toluene solution containing 7.6 g of 4-vinylphenyl-(N-phenyl, N-ethyl)amine was added dropwise with stirring at room temperature. After the addition was completed, the mixture was stirred at 70° C. for 3 hours, and then the solvent was removed under reduced pressure to obtain oily pale yellow 4-(N-ethyl-N-phenylamino)-[2-(triethoxysilyl)ethyl]benzene in an amount of 7.8 g.

Ionization potential of this compound measured by atmospheric photoelectron analysis (using a surface analyzer AC-1, manufactured by Riken Keiki K.K.) was 6.3 eV.

This compound was applied onto a substrate of copper by the wirebar coat method and subjected to thermal curing treatment at 120° C. for 12 hours to form a film of about 5 μm. Next, a semi-transparent electrode of gold was formed by the vapor deposition.

The drift mobility of this sample was measured by the Time-of-flight method using a nitrogen laser with a pulse width of 3 nsec. and a wavelength of 337 nm and found to be $2\times10^{-8}$ $cm^2/Vsec$.

EXAMPLE 1

A solution produced by dissolving 5 parts by weight of alcohol soluble copolymer nylon (tradename: Amilan CM-8000, Toray) into 95 parts by weight of methanol was applied through immersion coating onto the outer surface of an aluminum cylinder with an outer diameter of 80 mm which had undergone surface processing. It was allowed to dry at 80° C. for 10 min to produce a 1 μm thick undercoat layer.

Then, 5 parts by weight of a bisazo pigment described below were added to a solution which was produced by dissolving 2 parts by weight of polyvinylbenzal (benzal conversion being 75% or more) into 95 parts by weight of cyclohexanone, and the mixture was dispersed with a sandmill for 20 hours to prepare a dispersant for a charge generating layer.

The resulting dispersant was applied through immersion coating onto the undercoat layer in such a manner that the resulting layer, after being dried, had a thickness of 0.2 μm.

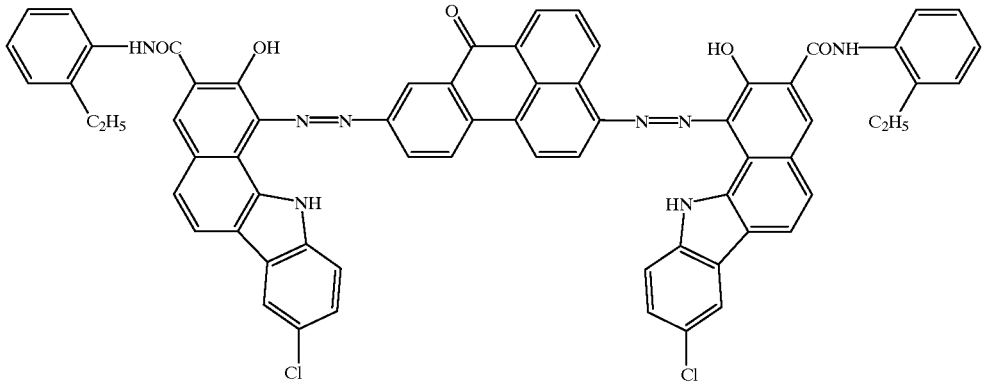

Then, to a solution produced by dissolving 5 parts by weight of triarylamine compound having a structure described below and 5 parts by weight of a polycarbonate resin (tradename: Z-200, Mitsubishi Gas Chemical) in 70 parts by weight of chlorobenzene, which solution serves as a material of an electric charge transporting layer, added was 0.3 part by weight of silicone resin fine particles having an average particle diameter of 2 μm, and the mixture was applied through immersion coating onto the above charge generating layer in such a manner that the newly added layer, after being dried, had a thickness of 10 μm.

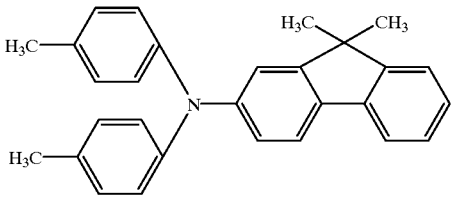

Then, a solution produced by adding 167 parts by weight of toluene and 100 parts by weight of 4-[N,N-bis(3,4-dimethylphenyl)amino]-[2-(triethoxysilyl)ethyl]benzene synthesized in Synthesis Example 3 to 2 parts by weight of dibutyltin diacetate was applied through spray coating.

The assembly was allowed to dry at 140° C. for 4 hours, and a transparent, even surface-protecting layer with a thickness of 2 μm was formed thereupon through thermal curing.

The resulting electrophotographic photosensitive member, after being charged with −700V, was exposed to light with a wavelength of 680 nm, and its photographic performance was studied: E1/2 (light exposure necessary for lowering the charge to −350V) was 1.2 $\mu J/cm^2$ and the residual potential was −16V. The performance was satisfactory.

A Canon-manufactured digital full-color copying machine (CLC-500) was so modified as to give a spot having a diameter ($1/e^2$) of 63.5 μm in the subsidiary scanning direction, and of 20 μm in the main scanning direction, to test the photosensitive member of this Example. The initial charging potential was set to −400V and the electrophotographic performance of the photosensitive member was studied. The photosensitive member gave satisfactory results: the images showed no black dots due to stray injection of charges even after a 100,000 sheet continuous running test as well as at the initial stage of the test; the wear of the photosensitive member after the test was only 1.5 μm; it gave images excellent in uniformity; and its tone reproducibility was also good, giving 256 tones at 400 dpi.

COMPARATIVE EXAMPLE 1

An electrophotographic photosensitive member produced in the same manner as in Example 1 except that no protective layer was coated evaluated of its electrophotographic performance. After it had undergone a 20,000 sheet running test, it suffered a great number of black dots and the quality of images thereupon was impaired. The wear of the photosensitive member was as large as 5 μm after 20,000 sheets.

EXAMPLE 2

167 Parts by weight of a phenol resin (tradename: Plyophen, Dainippon Ink & Chemicals) were dissolved into 100 parts by weight of methylcellosolve, to which were added 200 parts by weight of electroconductive barium sulfate ultra-fine particles (primary particle size being 50 nm) and 3 parts by weight of silicone resin particles having an average diameter of 2 μm. The mixture, after being dispersed, was applied through immersion coating onto the outer surface of an aluminum cylinder with an outer diameter of 30 mm which had been prepared through extraction processing. The coat was dried to produce a 15 μm thick electroconductive layer.

A solution produced by dissolving 5 parts by weight of alcohol soluble copolymer nylon (tradename: Amilan CM-8000, Toray) into 95 parts by weight of methanol was applied through immersion coating onto above electroconductive layer. The coat was allowed to dry at 80° C. for 10 min to produce a 1 μm thick undercoat layer.

Then, 5 parts by weight of an oxytitaniumphthalocyanine pigment which has high peaks at Bragg angles (2θ±0.2°) of 9.0°, 14.2°, 23.9° and 27.1° when examined by CuKa characteristic X-ray analysis, was added to a solution which was produced by dissolving 2 parts by weight of polyvinylbenzal (benzal conversion being 75% or more) into 95 parts by weight of cyclohexanone, and the mixture was dispersed with a sandmill for 2 hours to prepare a dispersant of the charge generating layer.

The resulting dispersant was applied through immersion coating onto the undercoat layer in such a manner that the resulting layer, after being dried, had a thickness of 0.2 μm.

Then, 100 parts by weight of organosilicon-modified triarylamine compound synthesized in Synthesis Example 4 was dissolved to 167 parts by weight of toluene, and 2 parts by weight of dibutyltin diacetate was added to the mixture and mixed. The mixture was applied through immersion coating onto the charge generating layer. It was dried at 120° C. for 5 hours for thermal curing, to form a clear, uniform charge transporting layer of 10 μm thickness.

Its pencil hardness was 5H, and has an angle of 105° in contact with water.

The resulting electrophotographic photosensitive member, after being charged with −700V, had 40V of dark attenuation in a surface potential after 1 second without exposing to light. Its electrophotographic performance was studied by using light with a wavelength of 680 nm: $E_{1/2}$ (light exposure necessary for lowering the charge to −350V) was 0.2 μJ/cm$^2$ and the residual potential was −22V. The performance was found satisfactory.

A Canon-manufactured laser beam printer (LBP-8IV) was so modified as to give a spot (1/e$^2$) having a diameter of 63.5 μm in the subsidiary scanning direction, and of 20 μm in the main scanning direction, to test the photosensitive member of this invention. The initial charging potential was set to −500V and the electrophotographic performance of the photosensitive member was studied. Its performance was satisfactory: after a 4,000 sheet running test, its wear was not more than 0.1 μm; its angle in contact with water was 100°; its images suffered no notable deteriorations; and pixel reproducibility at highlighted portions was also good, in the face of input signals corresponding with 600 dpi.

COMPARATIVE EXAMPLE 2

5 Parts by weight of the triarylamine compound used in Example 1, and 5 parts by weight of a polycarbonate resin (tradename: Z-200, Mitsubishi Gas Chemicals) were dissolved into 70 parts by weight of chlorobenzene to produce a solution for charge transporting layer. This solution was applied through immersion coating onto the charge generating layer prepared in Example 2, and it was dried to form a charge transporting layer of 10 μm thickness. The resulting photosensitive member was evaluated in the same manner as in Example 2 above. A 4,000 sheet continuous running test revealed that its performance was poor: interference streaks and black dots appeared, the wear was as large as 1.8 μm, it gave a small angle of 72° in contact with water; and the pixel reproducibility at highlighted portions of 600 dpi was poor and uneven.

EXAMPLE 3

167 Parts by weight of a phenol resin (tradename: Plyophen, Dainippon Ink & Chemicals) were dissolved into 100 parts by weight of methylcellosolve, into which were dispersed 200 parts by weight of electroconductive barium sulfate ultra-fine particles (primary particle size being 50 nm). The mixture was applied through immersion coating onto the outer surface of an aluminum cylinder prepared as in Example 2 such that it gave, after being dried, a 10 μm thick layer. Onto this electroconductive substrate were formed a undercoat layer of 1 μm thickness and a charge generating layer of 0.2 μm thickness in the same manner as in Example 2.

Then, 100 parts by weight of organosilicon-modified triarylamine compound synthesized in Synthesis Example 3 was dissolved to 167 parts by weight of toluene, and 2 parts by weight of dibutyltin diacetate was added to the mixture. The mixture was further added with 1.25 part by weight of $SiO_2$ fine particles having an average diameter of 3 μm. The blend was applied through immersion coating onto the charge generating layer. It was dried at 120° C. for 5 hours for thermal curing, to produce a charge transporting layer of 10 μm thickness.

The specimen, when observed by microscopy, was transparent and uniform except for $SiO_2$ particles.

Its pencil hardness was 4H, and has an angle of 110° in contact with water.

This electrophotographic photosensitive member, after being charged with −700V, was exposed to light with a wavelength of 680 nm, and its electrophotographic performance was studied: $E_{1/2}$ (light exposure necessary for lowering the charge to −350V) was 0.23 $\mu$J/cm$^2$ and the residual potential was −21V. The performance was found satisfactory.

The photosensitive member of this invention was applied to the same laser beam printer as used in Example 2 to be tested of its performance. The initial charging potential was set to −500V. Its performance was satisfactory: after a 10,000 sheet running test, the wear of the photosensitive member was extremely small, that is, 0.2 $\mu$m; its angle in contact with water was 102°, a satisfactory value; its images suffered no notable deteriorations such as black dots and interference streaks; and pixel reproducibility at highlighted portions was also good, in the face of input signals corresponding with 600 dpi.

EXAMPLE 4

Layers up to a charge generating layer were formed in the same manner as in Example 1.

Then, to the same solution used to form a charge transporting layer in Example 1 added was 0.1 part by weight of silicone fine particles having an average diameter of 2 $\mu$m, and the mixture was applied through immersion coating onto said charge generating layer to form, after being dried, a layer of 9 $\mu$m thickness.

Then, 100 parts by weight of 4-[N,N-bis(3,4-dimethylphenyl)amino]-[2-(triethoxysilyl)ethyl]benzene synthesized in Synthesis Example 3 as a surface protecting layer was dissolved to 167 parts by weight of toluene, and 2 parts by weight of dibutyltin diacetate was added to the mixture and mixed. The mixture was applied through spray coating.

The assembly was allowed to dry at 140° C. for 4 hours, and a clear, even surface protecting layer with a thickness of 3 $\mu$m was formed thereupon after thermal curing. Its pencil hardness was 2H, and has an angle of 115° in contact with water.

The resulting electrophotographic photosensitive member was evaluated of its electrophotographic performance in the same manner as in Example 1: $E_{1/2}$ was 1.00 $\mu$J/cm$^2$ and the residual potential was −25V. The performance was satisfactory.

The electrophotographic photosensitive member was applied to the same digital full-color copying machine as used in Example 1 to be evaluated of its imaging performance. The initial charging potential was set to −400V. A 10,000 sheet running test revealed that the photosensitive member was satisfactory in performance: its wear after the test was extremely small or 0.13 $\mu$m; its angle in contact with water was 109°; and it gave images excellent in reproducibility both at highlighted portions and at highly concentrated portions.

EXAMPLE 5

Layers up to a charge generating layer were formed in the same manner as in Example 2.

Then, 100 parts by weight of the organosilicon-modified triarylamine compound synthesized in Synthesis Example 8 was dissolved in 167 parts by weight of toluene, and 2 parts by weight of dibutyltin diacetate was added to the mixture and mixed. The resulting mixture was applied through immersion coating onto the charge generating layer as mentioned above. It was dried at 120° C. for 5 hours for thermal curing, to form a charge transporting layer of 10 $\mu$m thickness. Thus, a photosensitive member of this invention was produced.

Its pencil hardness was 5H, and has an angle of 107° in contact with water.

It was evaluated of its electrophotographic performance in the same manner as in Example 2: $E_{1/2}$ was 0.20 $\mu$J/cm$^2$ and the residual potential was −25V.

This photosensitive member was applied to the same laser beam printer as used in Example 2 to be tested of its performance. The initial charging potential was set to −500 V. Its performance was satisfactory: after a 10,000 sheet running test, its wear was extremely small, that is, 0.28 $\mu$m; its angle in contact with water was 98°, a satisfactory value; its images suffered no notable flaws such as black dots and interference streaks; and pixel reproducibility at highlighted portions was also good, in the face of input signals corresponding with 600 dpi.

What is claimed is:

1. An electrophotographic photosensitive member comprising a substrate and a photosensitive layer thereupon, wherein a surface layer of the electrophotographic photosensitive member contains a resin consisting of a compound which is obtained by polycondensing an organosilicon-modified positive hole transporting compound as represented by the formula (I):

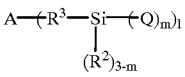

(I)

wherein A is represented by the following formula (II):

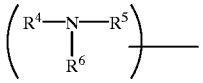

(II)

where $R^4$, $R^5$ and $R^6$ are organic groups, at least one of them represents an aromatic hydrocarbon cyclic group or heterocyclic group, and $R^4$, $R^5$ and $R^6$ may be the same, or different from each other, Q is a hydrolyzing group or hydroxyl group, $R^2$ is a substituted or unsubstituted monovalent hydrocarbon group, $R^3$ is a substituted or unsubstituted alkylene or arylene group bound to an aromatic hydrocarbon cyclic group or a heterocyclic group of said $R^4$, $R^5$ or $R^6$, "m" is an integer of 1 to 3, "l" is a positive integer, and "m" times "l" is 3 or more.

2. An electrophotographic photosensitive member according to claim 1, wherein "m" is an integer of 3.

3. An electrophotographic photosensitive member according to claim 1 or 2, wherein the organosilicon-modified positive hole transporting compound has an ionizing potential of 4.5 to 6.2 eV.

4. An electrophotographic photosensitive member according to claim 1 or 2, wherein the organosilicon-modified positive hole transporting compound has a drift mobility of $1\times10^{-7}$ cm$^2$/V.sec or more.

5. A process cartridge, comprising an electrophotographic photosensitive member, and at least one means selected from the group consisting of a charging means, a developing means and a cleaning means, wherein:

the electrophotographic photosensitive member and at least one means selected from the group are assembled into a unit; and the electrophotographic photosensitive member comprises a substrate and a photosensitive layer thereupon, wherein a surface layer of the electrophotographic photosensitive member contains a resin consisting of a compound which is obtained by polycondensing an organosilicon-modified positive hole transporting compound represented by the following formula (I):

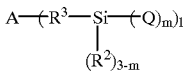

(I)

wherein A is represented by the following formula (II):

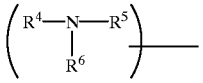

(II)

where $R^4$, $R^5$ and $R^6$ are organic groups, at least one of them represents an aromatic hydrocarbon cyclic group or heterocyclic group, and $R^4$, $R^5$ and $R^6$ may be the same, or different from each other, Q is a hydrolyzing group or hydroxyl group, $R^2$ is a substituted or unsubstituted monovalent hydrocarbon group, $R^3$ is a substituted or unsubstituted alkylene or arylene group bound to an aromatic hydrocarbon cyclic group or a heterocyclic group of said $R^4$, $R^5$ or $R^6$, "m" is an integer of 1 to 3, "l" is a positive integer, and "m" times "l" is 3 or more.

6. A process cartridge according to claim 5, wherein "m" is an integer of 3.

7. A process cartridge according to claim 5 or 6, wherein the organosilicon-modified positive hole transporting compound has an ionizing potential of 4.5 to 6.2 eV.

8. A process cartridge according to claim 5 or 6, wherein the organosilicon-modified positive hole transporting compound has a drift mobility of $1\times10^{-7}$ $cm^2$/V.sec or more.

9. An image forming apparatus, comprising an electrophotographic photosensitive member, a charging means, an exposure means, a developing means and a transferring means, wherein:

the electrophotographic photosensitive member comprises a substrate and a photosensitive layer thereupon, wherein a surface layer of the electrophotographic photosensitive member contains a resin consisting of a compound which is obtained by polycondensing an organosilicon-modified positive hole transporting compound represented by the following formula (I):

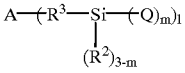

(I)

wherein A is represented by the following formula (II):

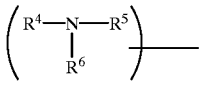

(II)

where $R^4$, $R^5$ and $R^6$ are organic groups, at least one of them represents an aromatic hydrocarbon cyclic group or heterocyclic group, and $R^4$, $R^5$ and $R^6$ may be the same, or different from each other, Q is a hydrolyzing group or hydroxyl group, $R^2$ is a substituted or unsubstituted monovalent hydrocarbon group, $R^3$ is a substituted or unsubstituted alkylene or arylene group, bound to an aromatic hydrocarbon cyclic group or a heterocyclic group of said $R^4$, $R^5$ or $R^6$, "m" is an integer of 1 to 3, "l" is a positive integer, and "m" times "l" is 3 or more.

10. An image forming apparatus according to claim 9, wherein "m" is an integer of 3.

11. An image forming apparatus according to claim 9 or 10, wherein the organosilicon-modified positive hole transporting compound has an ionizing potential of 4.5 to 6.2 eV.

12. An image forming apparatus according to claim 9 or 10, wherein the organosilicon-modified positive hole transporting compound has a drift mobility of $1\times10^{-7}$ $cm^2$/V. sec or more.

* * * * *

UNITED STATES PATENT AND TRADEMARK OFFICE

CERTIFICATE OF CORRECTION

PATENT NO. : 6,296,978 B1
DATED : October 2, 2001
INVENTOR(S) : Itaru Takaya et al.

It is certified that error appears in the above-identified patent and that said Letters Patent is hereby corrected as shown below:

Title page,
Item [57], ABSTRACT, "only" should read -- of --.

Column 2,
Line 15, "only an" should read -- of an --.

Column 3,
Line 1, "only an" should read -- of an --; and
Line 49, "contain includes," should read -- include, --.

Column 4,
Line 30, "is" should read -- and is --.

Column 7,
Line 46, "not" should be deleted; and
Line 60, "positionis" should read -- position is --.

Column 8,
Line 17, "take," should read -- takes, --.

Column 13,
Line 9, "After" should read -- After being --; and
Line 66, "was obtained" should be deleted.

UNITED STATES PATENT AND TRADEMARK OFFICE

CERTIFICATE OF CORRECTION

PATENT NO. : 6,296,978 B1 
DATED : October 2, 2001
INVENTOR(S) : Itaru Takaya et al.

It is certified that error appears in the above-identified patent and that said Letters Patent is hereby corrected as shown below:

Column 14,
Line 64, "After" should read -- After being --.

Column 21,
Line 43, "CuKa" should read -- CuK $\alpha$ --.

Signed and Sealed this

Second Day of July, 2002

*Attest:*

JAMES E. ROGAN
*Director of the United States Patent and Trademark Office*

*Attesting Officer*